US005214943A

United States Patent [19]

Fleissner

[11] Patent Number: 5,214,943

[45] Date of Patent: Jun. 1, 1993

[54] APPARATUS FOR LABORATORY DYEING OF A SAMPLE PIECE

[75] Inventor: Gerold Fleissner, Chur, Switzerland

[73] Assignee: Vepa AG, Riehen, Switzerland

[21] Appl. No.: 696,025

[22] Filed: May 6, 1991

[30] Foreign Application Priority Data

May 5, 1990 [DE] Fed. Rep. of Germany ..... 4014445

[51] Int. Cl.[5] ..... D06B 1/06; D06B 21/00; D06B 23/04

[52] U.S. Cl. ..... 68/5 C; 68/12.07; 68/205 R; 68/210

[58] Field of Search ..... 68/5 C, 8, 9, 10, 12.07, 68/205 R, 210

[56] References Cited

U.S. PATENT DOCUMENTS 318,205 5/1885 Rau ..... 68/5 C
3,402,577 9/1968 Blount, Jr. et al. ..... 68/5 C X
4,656,845 4/1987 Fleissner ..... 68/205 R

FOREIGN PATENT DOCUMENTS 53079 9/1942 Switzerland ..... 68/8

*Primary Examiner*—Philip R. Coe
*Attorney, Agent, or Firm*—Antonelli, Terry, Stout & Kraus

[57] ABSTRACT

Laboratory-scale dyeing of samples of lengths of material must correspond to the continuous process conditions as executed in practice in order to obtain comparable dyeing results. For this purpose, the provision is made of joining the sample piece into a tube and of pushing same onto a roll which revolves continuously during dyestuff application as well as during the steaming procedure. For performing this laboratory dyeing-steaming cycle, it is advantageous to arrange the dyeing roll on a rocking lever pivotable from a dyeing position below the dyestuff applicator into a steaming position below a steamer hood. The steamer hood, for steaming purposes, need merely be moved downwards to immerse the dyeing roller in total into the steam atmosphere.

19 Claims, 2 Drawing Sheets

APPARATUS FOR LABORATORY DYEING OF A SAMPLE PIECE

BACKGROUND OF THE INVENTION

This invention relates to an apparatus for laboratory dyeing of, for example, carpet samples by the application of a defined amount of dyestuff onto the face of the carpet sample and transportation of this sample into a laboratory steamer wherein the sample is kept in motion.

In order to avoid rejects in the continuous dyeing manufacture of lengths of textile material, it is customary to test the respective dyeing effect at least on a laboratory scale. For this purpose, a sample piece of the length of material is conveyed over a dyestuff application and then introduced into the steamer for dye fixation. Only after the fixing step is the dye effect to be evaluated. For obtaining comparable production conditions even during laboratory dyeing, it is important to utilize the same application method and to record the exact amount of dyestuff applied. Also the steaming of the sample piece should, if at all possible, to carried out so that comparable production conditions are created. However, since a laboratory-scale continuous process dyeing plant is too expensive, one had to be satisfied, heretofore, with compromise solutions. Although the dyestuff was applied in accordance with the flow coating principle, the sample piece was disposed on an endless belt, with the drawback that the pike, for example when dyeing carpet material, was not opened up. Subsequently, the sample piece was transferred manually into the steamer. The best laboratory steamer was, heretofore, provided with a needle inlet, the sample piece being pinned to the needles thereof. On account of this fastening of the sample piece, the piece could then also be steamed in vertical extension—as customary in the production festoon steamers. Additionally, the sample piece could also be moved during the entire steaming period, namely repeatedly upwards and downwards.

It has been found time and again that this laboratory dyeing process is inadequate. Flawed continuous dyeing effects could not be avoided, solely due to the fact that also these laboratory dyeing conditions could not be reproduced in the continuous procedure.

SUMMARY OF THE INVENTION

This invention is based on the object of developing an apparatus for performing a dyeing process by means of which the same conditions can be obtained on a laboratory dyeing scale as in the full scale continuous production without having to set up an expensive continuous laboratory dyeing line in the laboratory.

Starting with the process of the type discussed above, the provision is made according to this invention, in order to solve the thus-posed problem, that the sample piece is joined or formed into a tube or an at least unilaterally open hose. This sample piece is then to be maintained constantly in an advancing motion during the dyestuff application, during transport into the steamer, and within the steamer proper. The advantage of this measure is unequivocal. The idea of joining the sample piece into a tube, rather than dyeing it in flat condition, and then to rotate this tube in a nonintermittent fashion during the subsequent treatments has the result that a continuous dyeing process can be performed on this finite sample piece. It will be understood that the sample piece formed into a tube or at least a unilaterally open hose is freely hanging or supported on the dyeing roll. It is also possible to fix the sample piece directly on the dyeing roll by adhesive tape, crushing tape, etc., or with a gripping or clamping device. In this case, the sample piece does hot hang free as a sack under the roll but is arranged closely to the roll and is fixed thereto.

The basic idea of producing a tube from the sample piece and the resultant continuous movement of this tube can be executed most simply if the tube is laterally pushed onto a dyeing roll revolving in driven fashion, and the dyeing roll, continuing its rotation, is displaced, together with the sample piece, after the dyestuff application into a steaming position and, during steaming, likewise rotates in a driven fashion. Thereby the steamer, wherein a steaming time of 3–5 minutes must be maintained, can be of compact structure although a continuous steaming procedure is simulated therein.

The apparatus for performing the dyeing this process consists of a lever, a dyeing roll rotatably supported at the upper free end thereof; this lever is movable from the dyeing position into the steaming position. In the steaming position, a steaming hood is then suitably mounted to be lowerable over the dyeing roll. Such a steamer advantageously exhibits small outer dimensions. This steamer can always be charged with steam, without a loss of steam, and can be rapidly made available for a new dye fixation step.

For an easy placement of the tube, the dyeing roll is supported at the lever in overhung position, and above the dyeing roller, in the dyeing position of the lever, a dyeing doctor blade is arranged which is connected with a dyestuff applicator operating in accordance with the flow coating principle, i.e. dyestuff is caused to flow onto the dyeing roller.

The lever is advantageously designed as an elbow lever, i.e. an elbow-shaped lever, and retained at the end in opposition to the dyeing roll in a pivot joint. The elbow lever, is this arrangement, should enclose an angle not much larger than 90°, so that, when the elbow lever is located in the steaming position, a lower leg is arranged approximately horizontally whereas the upper leg of the lever with the dyeing roll projects vertically from below into the steamer hood.

In order to start the dyeing procedure, it is advantageous to activate the entire apparatus by an automatically working operating device. The entire dyeing-steaming process can thus take place automatically. It is merely necessary to depress a key in order to perform the application of the dyestuff to the sample piece, the pivoting of the elbow lever into the dyeing position, and the dye fixation steaming. It should be additionally possible to set, at the operating device, the steaming period for the steaming of a sample so that, after elapse of this steaming time, the steamer hood is automatically lifted again in order to permit the return pivoting of the elbow lever into the dyeing position. Prior to a new dyeing step, it is then merely necessary to exchange the sample piece.

It proved to be especially advantageous to clean the dyestuff applicator before a new dyeing step. This cleaning procedure can likewise be performed automatically by the operating device, namely without loss of time during the steaming process.

Since, in the operation of the apparatus of this invention, the dyeing step should be finished within a short period of time to prevent overdyeing, it is necessary to terminate the dyestuff application in abrupt fashion. For this purpose, it is advantageous to insert, underneath the dyeing doctor blade, a bath catching plate extending over the operating width of the dyestuff applicator. This is possible after the dyeing doctor blade or the entire dye head has been swung upwards because only then is there enough space for the advancement of the bath catching plate. This bath catching plate is not only advantageous for the termination of a dyestuff application step but also for the conductance of the aforementioned cleaning step for the dye facility so that the water required for cleaning does not drain away in the direction of the dyeing roll but rather can be drained off by way of a separate bypass unit.

The separation of the dyestuff applicator and the dyeing roll by the bath catching plate is also advantageous for determining the exact amount of dyestuff applied and, in some cases, also the color shade. For this purpose, the dye bath flows normally over the doctor blade but does not run to the dyeing roll but rather back by way of the bath catching plate. This optional cycle can proceed until the desired dyeing conditions are present. Then the catching plate is pulled back and simultaneously the dyeing head is lowered.

BRIEF DESCRIPTION OF THE DRAWINGS

The accompanying drawing illustrates in FIGS. 1 and 2 embodiments of the apparatus according to this invention wherein.

Still further details of the invention will be described in detail with reference to this embodiment.

DETAILED DESCRIPTION OF THE DRAWINGS

Figure 1:
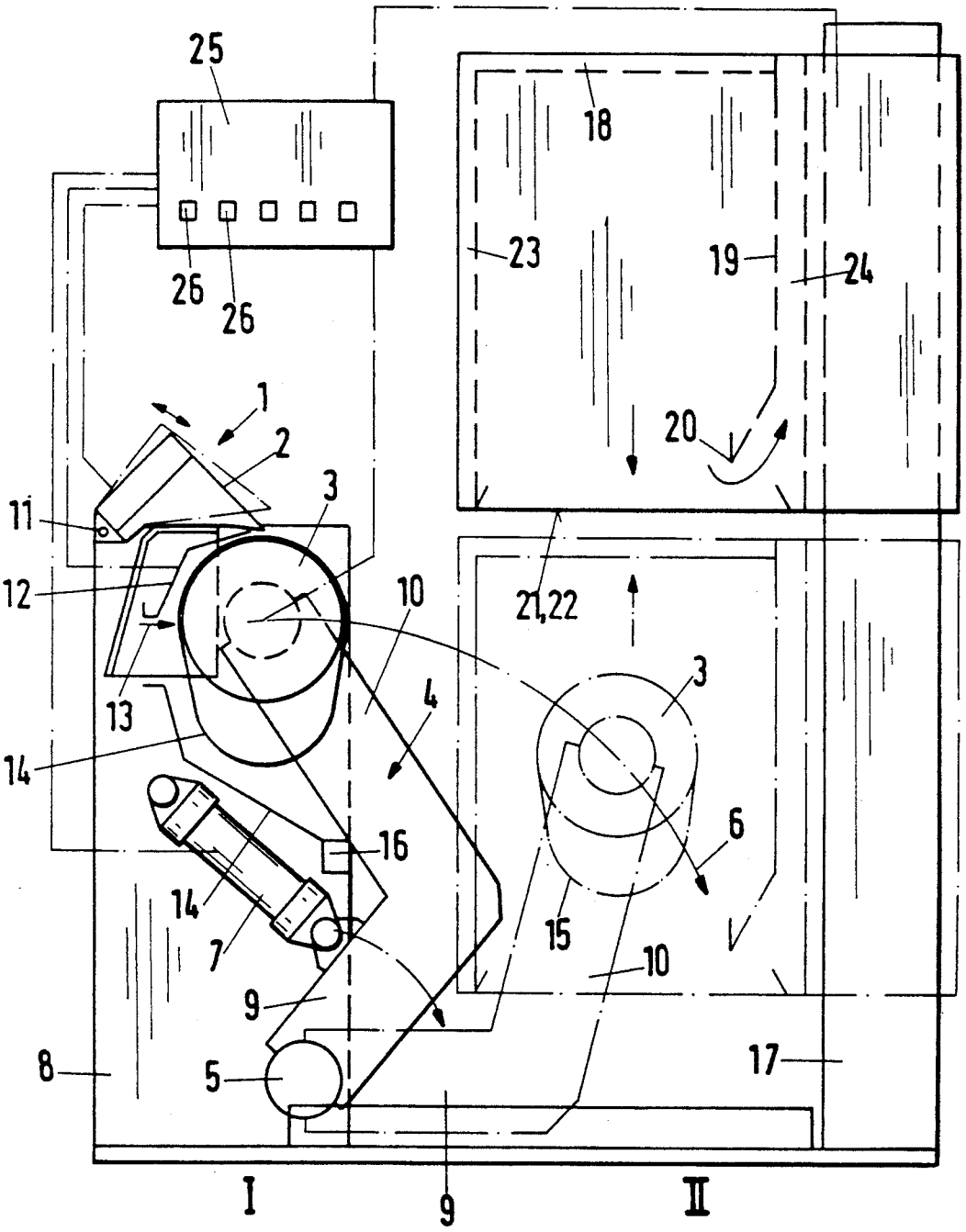
FIG. 1 shows an embodiment of the apparatus according to the invention.

Reference numeral 1 in FIG. 1 denotes in total the dyestuff applicator with a doctor blade 2 extending obliquely downwardly, the dyeing roll 3 being arranged therebelow in rotatably supported fashion. The dyeing roll 3 is mounted to an elbow-shaped lever 4 which can be displaced about the pivot joint 5 into the position illustrated in dotdash lines downwardly in the direction of arrow 6. The movement of the elbow-shaped lever 4 from the dyeing position I into the steaming position II is controlled by way of pressure piston-cylinder unit 7 articulated, on the one hand, to the column 8 of the dyestuff applicator 1 and, on the other hand, to the elbow-shaped lever 4. The lower leg 9 of the elbow lever 4 is arranged horizontally in the steaming position II; whereas the upper leg 10 of the elbow-shaped lever 4 is inclined upwardly but slight in the forward direction. Accordingly, these two legs 9, 10 form an angle which is a little larger than 90° and which also results in a stable position of the elbow-shaped lever 4 in the steaming position II.

The dyeing roll 3 at the upper end of the upper leg 10 of the lever 4 is connected to a motor, not shown, which nonintermittently drives the roll in the dyeing station I as well as in the steaming station II. The dyestuff applicator 1 illustrated at the upper end of the column 8 is described in detail in DE-3,522,320 A1 and U.S. Pat. No. 4,656,845. The dyestuff applicator 1 is mounted to be pivotable about a joint 11 in order to be able, for example, upon termination of the dyeing step to pivot the dyestuff applicator 1 in a counterclockwise direction. At the same time, a dye bath catching plate 12 arranged below the dyestuff applicator 1 and supported displaceably in the direction of arrow 13 is moved to below the dripping edge of the doctor blade 2; thus, the dye liquor draining from the dyestuff applicator 1 via the doctor blade 2 can be collected by the bath catching plate 12 and conducted away into a dyestuff return flow. An appropriate mechanism coordinates the movements of the upward pivoting of the dyestuff applicator 1 and the advancement 13 of the bath catching plate 12 to underneath the draining edge of the doctor blade 2.

Below the dyeing roll 3, a further catching plate 14 is arranged which is to collect the dye liquor that may drip off the sample piece 15 on the roll 3 but in any event the cleaning fluid, and remove same via a conduit 16 into a collecting tank.

A steamer is arranged laterally beside the column 8 with the dyestuff applicator 1, likewise on a column 17. The steamer consists of a downwardly open hood 18 extending at the column in the direction of the dyestuff applicator 1 and being retained to be displaceable from the top toward the bottom. The steamer rear wall 19 facing away from the dyeing station I terminates with its bottom edge 20 at a higher level than the three remaining walls 21–23. At the same time, a steam exhaust duct 24 adjoins this rear wall 19 over the width of the steamer hood, removing any excess steam introduced into the steamer. Thereby, a steam atmosphere sufficient for the dyeing conditions is constantly present in the steamer hood 18.

In case of a dyeing procedure, a tube of the sample piece is inverted over the dyeing roll 3; this tube is denoted by 15 in the drawing. The material of this sample piece has been cut out from a length of material, e.g., carpet, to be treated later on by the continuous process and has been made by means of a seam into this tube 15, thereby forming an endless sample piece. The dyeing roll 3 is supported in overhung, i.e. cantilevered, fashion at the lever 4 so that the inversion or application of the tube 15 onto the dyeing roll can be readily executed. For dyeing purposes, dye liquor then flows via the dyestuff applicator 1 onto the sample piece 15 in accordance with the flow coating principle, the sample piece—as mentioned -being fed as in the continuous operation over the dyeing roll 3. After a one-time revolution of the tube 15 around the dyeing roll 3, the liquor application step is stopped by means of the catching plate 12, and the lever 4 is pivoted by way of the pressure piston cylinder unit 7 from the dyeing position I into the steaming position II, illustrated by a dot-dash line in the drawing. Subsequently, the steamer hood 18 is lowered down into the steaming position, likewise shown in dot-dash lines, whereby the dyeing roll 3 arranged at the upper end of the top leg 10 of the elbow lever 4 is located in the center of the steam atmosphere of the steamer hood 18. Since the dyeing roll also rotates within the steaming chamber, the tube 15 is also moved forwards during steaming in the same transport direction as during the continuous processing of the material; consequently here, too, the same conditions are ambient as in a continuous process operation. After termination of the steaming procedure, the steamer hood is again lifted into the position shown in solid lines, the dyed tube 15 can be taken off the dyeing roll 3, and the lever 4 can again be swing into the dyeing position I. A new dyeing procedure can begin.

Such a dyeing process can be performed in fully automated fashion. For this purpose, an operating device 25, only schematically indicated in the drawing and consisting of an electronic unit, is provided. By operating a push button 26 "dyeing", the dyeing and steaming process takes place automatically with all required process conditions. The process consists, first of all, of driving the dyeing roll 3 with inverted piece 15, applying the made-ready dyestuff via the dyestuff applicator 1 onto the periphery of the sample piece 15, and terminating the dyestuff application comprising the upward pivoting of the dyestuff applicator 1 about the pivot joint 11 and advancement of the bath catching plate 12 in the direction of arrow 13. With the dyeing roll 3 continuing its driven revolution, the lever 4 is pivoted into the dyeing position II by activation of the pressure piston cylinder unit 7. The steamer 18 is lowered over the dyeing roll 3 which latter continues its rotation, and thus the steaming step commences. After a certain time which can likewise be set at the operating device 25, the steaming process is finished whereupon the steam hood 18 is automatically displaced again in the upward direction. After pivoting the elbow lever 4 back into the dyeing position, a new dyeing process can then begin. It is advantageous to conduct a cleaning cycle at the dyestuff applicator during this steaming process. This cleaning cycle consists in that a cleaning fluid, such as water, is now running over the doctor blade 2 in place of the dyestuff previously applied to the sample piece 15. Thereby, cleaning is effected not only of all of the conduits in the dyestuff applicator 1 but also of the doctor blade and likewise the remaining parts of this dyeing device. The water required for this purpose drains via the bath catching plate 12 or the catching plate 14 into an appropriate collecting tank. After termination of the cleaning step, the bath catching plate 12 is again moved back, likewise automatically—in opposition to arrow 13—whereupon the dyestuff applicator 1 can also again be pivoted in the clockwise direction into the position shown in a solid line.

Figure 2:
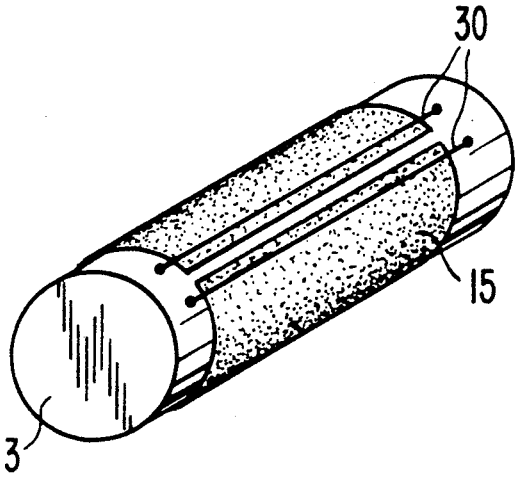
FIG. 2 shows a gripping device for holding a sample piece arranged on a dyeing roll.

FIG. 2 shows a perspective view of a gripping device 30 holding the sample piece 15 arranged on the dyeing roll 3.

What is claimed is:

1. An apparatus for laboratory dyeing of a sample piece which comprises a dyestuff applicator comprising a dyeing roll and a laboratory steamer, characterized in that said apparatus further comprises a lever for supporting the dyeing roll, in that the dyeing roll is rotatably supported at an upper free end of the lever and is movable on the lever from a dyeing position (I) into a steaming position (II), in that said laboratory steamer comprises a steamer hood mounted on a support, and in that in the steaming position (II), the steamer hood mounted on the support to be vertically movable is lowered downwardly over the dyeing roll.

2. An apparatus according to claim 1, characterized in that the apparatus further comprises a motor for rotating the dyeing roll and in that the dyeing roll on the lever is connected with the motor for rotating the roll.

3. An apparatus according to claim 1 or 2, characterized in that the dyeing roll is supported on the lever in a cantilevered fashion.

4. An apparatus according to one of claim 1 or 2, characterized in that the dyestuff applicator operating according to the flow coating principle includes a dyeing doctor blade that terminates above the dyeing roll in the dyeing position (I) of the lever.

5. An apparatus according to claim 4, characterized in that the apparatus further comprises a bath catching plate and in that the bath catching plate is movable in between the dyeing roll and a bottom edge of the dyeing doctor blade, the plate extending over an operating width of the dyestuff applicator.

6. An apparatus according to claim 5, characterized in that the apparatus further comprises a dye head and in that the dyeing doctor blade is supported, together with the dye head of the dyestuff applicator, to be pivotable upwardly away from the dyeing roll.

7. An apparatus according to claim 6, characterized in that an advancing motion of the bath catching plate is coordinated with an upward pivotal motion of the dyeing doctor blade and conversely.

8. An apparatus according to claim 1, characterized in that the apparatus further comprises a column for supporting the dyestuff applicator, a pivot joint, and a pressure piston cylinder unit arranged on the column for pivoting the lever about the pivot joint, in that the lever comprises a pivotal lever and in that the pressure piston cylinder unit pivots the lever.

9. An apparatus according to claim 8, characterized in that the pivotal lever comprises an elbow lever and, in that a lower end of the elbow lever provided with the pivot joint is oriented horizontally in the steaming position (II); whereas a free end of the elbow lever is oriented approximately perpendicularly to the lower end.

10. An apparatus according to claim 1, characterized in that the support for the laboratory steamer comprises a support column and in that the laboratory steamer is arranged to be movable upwardly and downwardly on the support column.

11. An apparatus according to claim 10, characterized in that the steamer hood comprises four walls and has a width, in that a rear wall of the steamer hood facing away from the dyeing position (I) terminates with a bottom edge at a higher level than three remaining walls of the steamer hood and in that a steam exhaust duct adjoins said rear wall over at last a part of the width of the steamer hood.

12. An apparatus according to claim 1, further characterized in that the apparatus comprises an automatically acting operating control device for the initiation and termination of a laboratory dyeing-steaming process and a drive mechanism for the dyeing roll, said control device activating at least:

(a) the drive mechanism of the dyeing roll, (b) an application of a dyestuff, which has been made available, onto a periphery of the sample piece, (e) pivoting of the lever from the dyeing position (I) into the steaming position (II), and (f) lowering of the steamer hood.

13. An apparatus according to claim 12, further characterized in that the apparatus comprises a timer unit for setting a steaming period, a unit for automatically lifting of the steamer hood, and a pressure piston cylinder unit, and in that the control operating device furthermore activates:

(g) the timer unit for setting the steaming period, (h) the unit for the automatic lifting of the steamer hood after termination of the steaming period, and (i) the actuation of the pressure piston cylinder unit for pivoting the lever back from the steaming position into the dyeing position.

14. An apparatus according to claim 12, characterized in that the apparatus further comprises a bath catch plate and a dyeing doctor blade and in that, for terminating the dyestuff application, the operating device (c) activates the advancement of the bath catching plate and upward pivoting of the dyeing doctor blade.

15. An apparatus according to claim 12 or claim 14, characterized in that, after termination of the dyeing process, the operating device initiates (d) a cleaning step including application of water at the dyestuff applicator during the steaming period.

16. An apparatus according to claim 15, characterized in that the operating device further operates so that (j) prior to a new dyeing procedure, beginning by application of dyestuff, the bath catching plate is retained in an advanced position for catching and draining of new dye liquor, and (k) only upon reaching the exact applied quantity and/or color, the bath catching plate is retracted, and the doctor blade is lowered.

17. An apparatus according to claim 1, further comprising means for securing a sample piece to be dyed on said dyeing roll.

18. An apparatus according to claim 17, wherein the securing means comprises a sample piece that is formed into a tubular structure which can be inverted on to a free end of the dyeing roll.

19. An apparatus according to claim 17, wherein said securing means further comprises an adhesive tape, a crushing tape or a gripping device for holding the sample piece on to the dyeing roll.

* * * * *